United States Patent [19]

Pratt

[11] Patent Number: 4,612,540

[45] Date of Patent: Sep. 16, 1986

[54] DIGITAL DISPLAY SYSTEM

[75] Inventor: John M. Pratt, Macclesfield, England

[73] Assignee: International Computers Limited, London, England

[21] Appl. No.: 488,368

[22] Filed: Apr. 25, 1983

[30] Foreign Application Priority Data

Apr. 30, 1982 [GB] United Kingdom ..... 8212587

[51] Int. Cl.[4] ..... G09G 1/00

[52] U.S. Cl. ..... 340/793; 340/723; 340/728; 340/744; 340/747

[58] Field of Search ..... 340/723, 727, 728, 732, 340/744, 747, 793; 358/284

[56] References Cited

U.S. PATENT DOCUMENTS

| | | | |
|---|---|---|---|
| 3,870,922 | 3/1975 | Shutoh | 340/747 |
| 3,984,664 | 10/1976 | Berwin | 340/732 |
| 4,158,200 | 6/1979 | Seitz et al. | 340/750 |
| 4,237,457 | 12/1980 | Houldsworth | 340/793 |
| 4,262,290 | 4/1981 | Vallins | 340/793 |
| 4,371,872 | 2/1983 | Rossman | 340/723 |
| 4,479,192 | 10/1984 | Yamagami | 340/744 |

OTHER PUBLICATIONS

F. C. Crow, "The Aliasing Problem in Computer-Generated Shaded Images", Communications of the AGM, Nov. 1977, pp. 799-805.

S. Gupta et al, "Filtering Edges for Gray-Scale Displays", Computer Graphics, Aug. 1981, pp. 1-5.

*Primary Examiner*—Gerald L. Brigance
*Assistant Examiner*—Jeffery A. Brier
*Attorney, Agent, or Firm*—Lee, Smith & Zickert

[57] ABSTRACT

The system displays linear features on a gray-scale or other multiple-intensity display device with greater apparent smoothness by selecting the intensities of picture elements in the neighbourhood of the feature in dependence on their closest distances to the feature. Straight lines are generated by a vector generator (4) which conducts scans across the line. The closest distance from the picture element currently reached by the scan to the center of the line is held in an accumulator (18), which at each step of the scan is incremented or decremented from a register (20 or 21) holding the change in the distance. Each scan is terminated when a comparator (26) indicates that the intensity has reached that of the background. This scanning technique allows lines of varying width to be displayed easily. The position of the picture element along the line is held in an accumulator 19, used to address a table (22) holding the width at that point. A similar scanning technique is used in a circle generator.

4 Claims, 16 Drawing Figures

DIGITAL DISPLAY SYSTEM

BACKGROUND OF THE INVENTION

This information relates to digital display systems.

A digital display is normally formed as an array of picture elements whose intensities can be individually controlled. Examples are digitally controlled raster-scanned CRTs and digital plotters. Early displays used only two values for the intensity of the picture elements, but more recent displays have allowed a greater range of intensities, either as a gray-scale monochrome display or as part of a color display.

The intensity with which each picture element is to be displayed is obtained by sampling the desired image. The crudest form of sampling simply assigns each picture element the intensity of the image at the centre point of the element. However it is well known that this approach leads to objectionable artifacts in the displayed image such as jagged edges, lines and Moire fringes in closely spaced lines. It is known that these effects can be suppressed by better sampling techniques which sample the image beyond the center points of the picture elements. When such a technique is used, when an edge passes between the center of two picture elements both elements are illuminated and their intensities depend on the distance from each of them to the edge. This approach yields smoother-looking edges and allows an apparent positioning to less than the spacing between picture-element center.

A digital system may retain a definition of the required image in one of two forms. First the image may be a pre-defined set of samples which have previously been obtained either from sampling the external scene (obtained e.g. as a TV image), or by synthetic composition of symbols (e.g. a character display). Alternatively, the image may be defined as a set of geometric figures (lines, circles, etc) which are to be converted to an image as and when required.

The correct generation of samples in systems of the first case is the subject of much published material, and if the image is of an external scene is generally implemented in image processing programs. In the specific case of synthetic generation of characters, samples of the desired character image are calculated to align with the sampling grid, and therefore avoid the worst of the visual defects. This technique is used in most character display devices. Improvements to this commonplace implementation were described in U.S. Pat. No. 4,158,200 to Seitz et al. This system used a pre-defined set of samples, which incorporated varying gray levels, in order to generate a smooth well shaped character on a display screen. The samples were stored in place of the conventional character ROM of such a character display system, but were precalculated to lie on the screen at a particular size, angle, and position relative to the raster scan of the display.

The transformation in size, angle, or position of an image represented by a pre-defined set of samples cannot easily be implemented owing to the fact that detail has been lost in the original sampling process. Because of this limitation systems which are required to provide such transformations use the alternative of defining the image as a set of geometrical figures. Geometric functions, such as $ax+by=c$ represent lines at any required resolution and can be transformed without loss of detail before sampling. This approach yields much superior results.

A sampling method for use in these circumstances is described in "The aliasing problem in computer-generated shaded images" by F. C. Crow, Communications of the AGM, November 1977, pages 799 to 805. This method derives each sample value by two dimensional integration of the neighbourhood of the sample. The geometric function is first calculated at a finer resolution than the sampling grid, the resultant fine image passed through a two dimensioned weighted integration, and the result used as the value for the sample point corresponding to the center of the integration. The result of this process is that visible defects caused by sampling are substantially suppressed in the final image. Unfortunately the computation of the integration consumes significant power and therefore this method is not generally adopted by implementors.

A simpler procedure for displaying lines is described in "Filtering edges for gray-scale displays" by S. Gupta and R. F. Sproull in Computer Graphics, August 1981, pages 1 to 5. The intensity of a picture element near the line is determined from its perpendicular distance from the line. For each possible distance the appropriate intensity is precalculated using a two-dimensional integration and the results are loaded into a look-up table. This table is addressed by the perpendicular distance of the picture element from the line to obtain its intensity. The advantage of using the perpendicular distance is that the intensities may be calculated once only and then used whatever the angle of the line on the display. It is still however necessary to decide which elements to treat in this way. The article uses a modification of Bresenham's Algorithm. For a line of unit width—taking the distance between the center of neighbouring picture elements as the unit of distance—the picture elements which will be illuminated to display the line are chosen in threes. If the line lies in the first octant (that is, makes an angle with the horizontal in the range 0° to 45°) the line is displayed by illuminating three picture elements in each column. Starting from the three elements representing the line in one column the three elements representing it in the next column to the right are obtained by displacing the original three elements either horizontally to the right or diagonally up at 45°. Which possibility is chosen is governed by which of the two possible positions for the center element of the three lies closest to the center of the line being represented.

SUMMARY OF THE INVENTION

This invention provides a method of displaying a linear feature on a display device which produces an image as an array of picture elements arranged in lines, each picture element being capable of being displayed with a selected one from more than two possible intensities, the method comprising;

(A) for each of the said lines of picture elements that crosses the said feature conducting a scan which comprises successively for individual picture elements in the line:

(a) deriving an indication of the closest distance from a sampling point corresponding to the element to an ideal line characterising the feature, (b) from at least that indication deriving an indication of an intensity for the picture element, and (c) conducting a comparison providing an indication if the intensity for the picture element has reached a limiting value, the scan being terminated in response to an indication that the intensity of a picture element has reached the limiting value; and (B) controlling the display device so that picture elements included in the said scans are displayed with the indicated intensity.

The invention also provides apparatus for controlling a digital display device to display a linear feature, the dsplay device producing an image as an array of picture elements arranged in lines, each picture element being capable of being displayed with a selected one from more than two possible intensities, the apparatus comprising;

a first and a second picture-element address register, the first indicating a position for the picture element in the one of the said lines in which it lies and the second indicating a position for that line;

sequencing means for conducting a sequence of scans, the sequencing means in each such scan stepping the contents of the first address register from the value corresponding to one picture element to that corresponding to another and being responsive to a scan-changing signal at least to step the contents of the second address register from the value corresponding to one line to that corresponding to another, means for outputting an indication of the closest distance from a sampling point corresponding to a picture element whose position is indicated by the address registers to an ideal line characterising the linear feature;

comparison means for issuing the said scan.changing signal when the intensity indication reaches a limiting value;

intensity-indication generating means responsive at least to the closest-distance indication to output an intensity indication for the picture element whose position is indicated by the address registers; and means responsive to the intensity indications for issuing a drive signal to control a digital display device to display corresponding picture elements with the indicated intensity.

The invention therefore selects the elements which will be illuminated to display the line in response to their intensity, unlike the method described above, which selects them according to their position.

The linear feature may be a line, an edge or a wedge and may be straight or curved.

The invention also allows features of different widths to be displayed in a simple manner. For this purpose the indication of intensity is derived in response both to the indication of the closest distance and to an indication of the width of the feature. The scanning procedure of the invention then automatically leads to a longer scan for thicker lines, unlike the prior method described above, which must modify its algorithm for lines of different widths.

Preferably, for each picture element of the said scans an indication is derived of the position of the element along the length of the linear feature, from which indication the width indication for that element is derived. In this manner lines of varying thickness may be drawn.

BRIEF DESCRIPTION OF THE DRAWINGS

An example of a display system constructed and operating in accordance with the invention will now be described in greater detail with reference to the accompanying drawings, in which.

DESCRIPTION OF THE PREFERRED EMBODIMENT

Outline of the system

Figure 1:
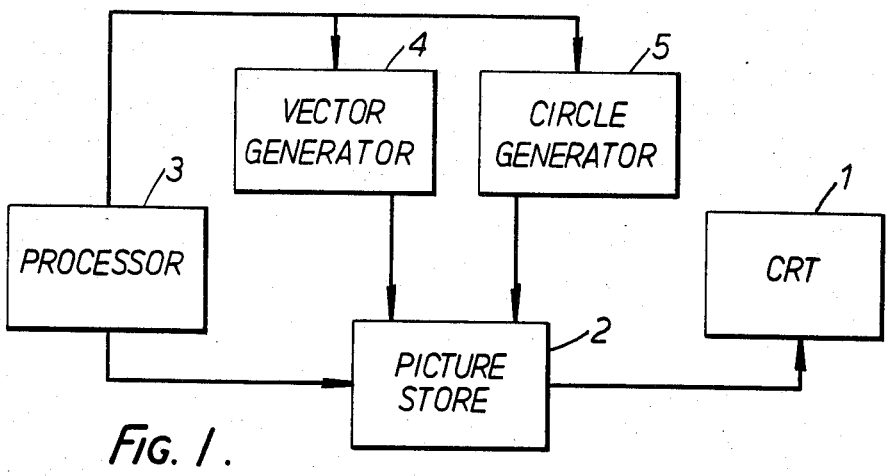
FIG. 1 is a block diagram of the overall system.

Referring to the FIG. 1, the system forms a display on a digitally controlled raster-scanned CRT 1. The display is made up of picture elements each of which is a spot created by intensifying the beam of the CRT 1. The picture elements lie in the scan lines of the beam and form a square array. Each picture element may have one of several possible intensities or gray levels.

The CRT 1 is refreshed from a picture store 2 which has a location for each picture element. Each location holds a value representing the intensity of that element. These values are read out in synchronism with the scan of the CRT and used to control the intensity of the beam.

A processor 3 determines the image that is to be displayed. It holds a high-level definition of the image and is capable of writing the intensities of individual picture elements into the picture store 2. However, for straight lines the calculation of intensities is carried out by a vector generator 4 and for circles it is carried out by a circle generator 5. The processor 3 passes the parameters of the straight line or circle to the vector generator 4 or circle generator 5, which calculates the picture element intensities in the neighbourhood of the object and writes them into the picture store 2.

Vector Generator

Figure 2:
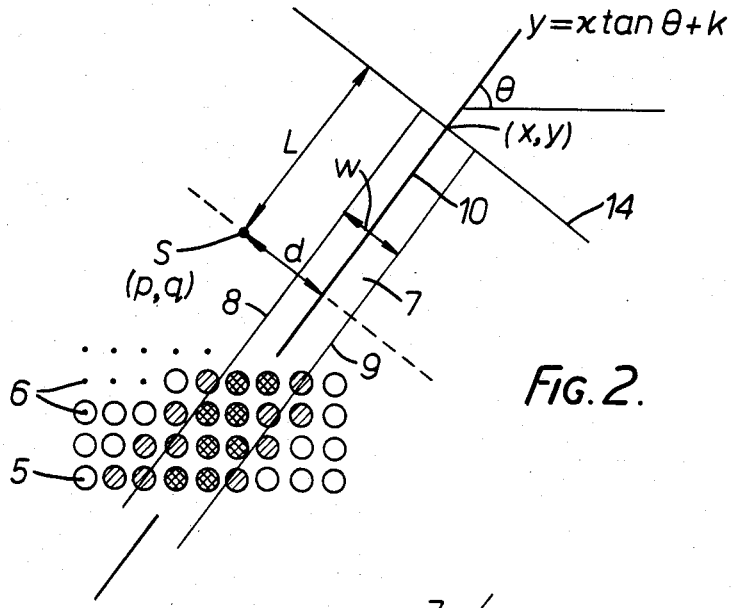
FIG. 2 is a diagram illustrating the display of a straight line.

A fragment of the display of a straight line is shown in FIG. 2. The picture elements are shown as spots 6 which for clarity are shown distinct, although in practice they may well be intended to overlap. The points at the centres of the picture elements are used as sample points in calculating intensities. The co-ordinates of a sample point will be denoted by (p,q), using the distance between neighbouring points as the unit of distance. So increasing p by 1 corresponds to moving from one sample point to the next on the right and increasing q by 1 corresponds to moving from one sample point to the next above it.

The desired image of a line 7 of width w is shown bounded on the left by an edge 8 and on the right by an edge 9. The course of the line 7 is defined in the processor 3 by the equation $y=x \tan \theta+k$ of its centre line 10 and the width w is specified as a separate parameter. It will be assumed for the present that the line is to be displayed at full intensity, represented by 1, on a zero intensity background.

If only those picture elements 6 whose sample points lie inside the edges 8 and 9 were illuminated the image of the line 8 would have a jagged appearance. To make it appear smoother and more precisely positioned the picture elements in the neighbourhood of the edges 8 and 9, both inside them and outside them, are partially illuminated with varying intensities. The actual intensity for each sample point is governed by the closest distance d from that point to the center line 10. The intensity for each sample point is calculated by carrying out a one-dimensional weighted integration along the line through that sample normal to the center line 10. For a particular sample point S at (p,q) this line is shown as the line 11.

Figure 3:
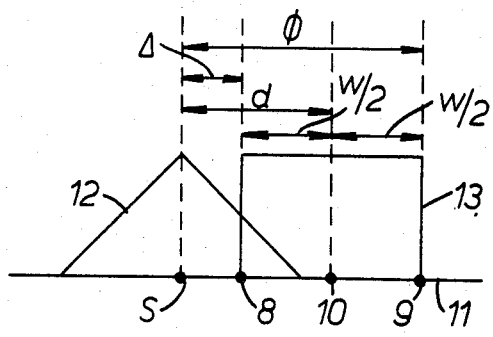
FIG. 3 shows in more detail the sampling function and quantities used in calculating intensities for a straight line.

Referring to FIG. 3, the calculation uses a sampling function 12 of triangular shape with height 1, width 2 and area 1 positioned so that its vertex lies over the sample point. The product of the sampling function and a function 13 representing the desired intensity of the line 7 at the different points on the normal is then integrated along the normal and yields the intensity for the sample point considered. Since the function 13 is of uniform height equal to 1 this integration reduces, in this one-dimensional case, to the calculation of the area of overlap of the functions 12 and 13.

Two quantities $\Delta$ and $\phi$ are used in calculating this area. Taking the point S as the one considered, and assuming first that S is to the left of the center line 10, $\Delta$ is then defined as the distance from S to the left hand edge 8, taken as positive if S is to the left of the edge 8 and $\phi$ is then defined as the distance from the point S to the right-hand edge 9, also taken as positive if S is to the left of the edge 9. Thus $$\Delta=d-w/2$$

$$\phi=d+w/2$$

Figure 4:
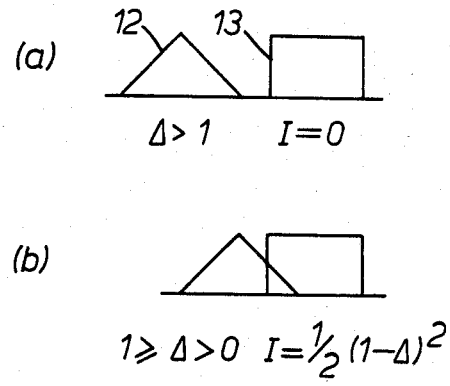
FIGS. 4*a*–4*d* and 5*a* and 5*b* show the various cases involved in calculating intensities for a straight line of varying position and width.

For the case where $\phi$ is greater than 1 the right edge of the line is beyond the sample and there are four possibilities because of the discontinuous nature of the sampling function, as shown in FIG. 4:

(a) There is no overlap (b) The line is sampled only by the right half of the sampling function.

(c) The line is sampled by all of the right half and some of the left half of the sampling function.

(d) The sample is totally within the line.

The resultant intensities I are shown in FIG. 4.

Figure 5:
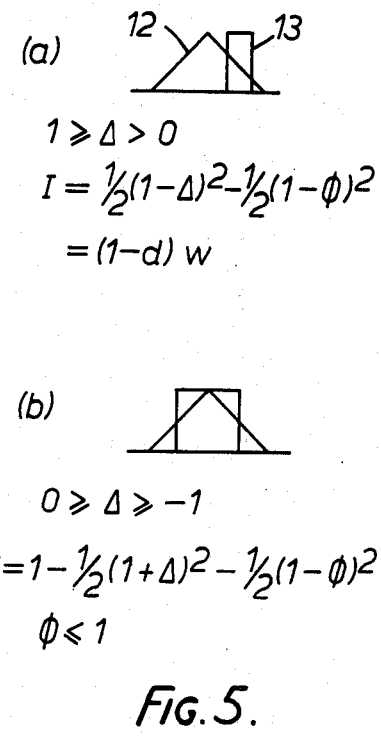

If $\phi$ is less than or equal to 1 the right edge of the line crosses the sample and there are two possibilities, as shown in FIG. 5:

(a) both left and right edges of the line cross the right-edge of the sampling function.

(b) the left edge of the line crosses the left edge of the sampling function and the right edge of the line crosses the right edge of the sampling function.

The resultant intensities I in these cases are shown in FIG. 5.

If S is to the right of the center line 10 it is convenient for computation to treat d as negative. Since the intensity is symmetrical on either side of the centre line 10 the intensities I for these cases are obtained from the same expressions as given in FIGS. 4 and 5 but substituting the absolute magnitude /d/ for d in the definitions of $\Delta$ and $\phi$. These quantities may therefore be generalised as the distances to the near and far edge respectively.

Using the expressions given in FIGS. 4 and 5 the intensities are evaluated for each pair of values of $\Delta$ and $\phi$ and the results are stored as a look-up table.

Distances $\Delta$ and $\phi$ and grey levels in this calculation may for example be quantised to one part in sixteen, that is, using four bits both for the gray levels and for the fractional part of distances. This, we find, gives a satisfactory appearance with an ordinary raster-scanned display. But greater precision may be used if greater accuracy is desired.

The method of scanning will now be described. The vector generator 4 operates by taking each picture element 6 in the neighbourhood of the line to be displayed in turn and calculating its perpendicular closest distance d from the center line 10. It also obtains the width w of the line measured on that perpendicular, and from the values of d and w calculates $\Delta$ and $\phi$ for the picture element being considered. These values are then used to access the look-up table and the resultant intensity is written into the picture store 2 at the location of the element concerned.

The order in which the picture elements are taken is a series of scans along lines crossing the image of the line to be displayed. As the intensity of each element is calculated it is not only written into the picture store 2 but also used to control the scanning. When, after crossing the line to be displayed, the calculated intensity reaches that of the background of the display, the current scan line is ended and the scanning sequence moves on to the next scan line.

Figure 6:
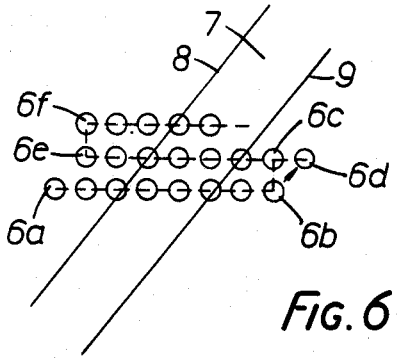
FIG. 6 shows the scanning method used in the vector generator.

Thus, referring to FIG. 6, which shows the case of a horizontal scan (a vertical scan could equally well be chosen) assume that the element **6*a* is the first in a line of elements which will be scanned to the right. Then the scan steps from each picture element to its neighbor on the right, corresponding to incrementing p repeatedly by 1. If we still assume for the present that the background is of zero intensity, then the first time the scan reaches an element, 6*b* say, of zero intensity after an element of non-zero intensity this line of the scan is ended and the scan steps vertically to an element 6*c* by changing q by one and leaving p unchanged. 6*b*** is therefore the extreme rightmost element of its scan line.

The intensity of the element **6*c* is calculated and written into the picture store 2. If it is zero the direction of scanning is reversed and the next element considered is that to its left. In other words p is now decremented repeatedly by 1. However, if the element 6*c* has a non-zero intensity the direction of scanning continues to be that of the previous scan line. That prevents the loss of any picture elements of non-zero intensity further from the line to be displayed than the element 6*c*. Only when a zero intensity is again reached, at an element 6*d*** say, is the direction of scan reversed. The initial value or values of this scan line will then be recalculated as the scan retraces its initial spur.

After the leftward scan has crossed the image of the line to be displayed it will again reach an element of zero intensity, **6*e* say, and will be ended. The scanning sequence will now again step vertically, to an element 6*f*, and its intensity will be calculated. When the slope of the line to be displayed is positive as shown in FIG. 6** this element must also be of zero intensity and the next rightward scan will start immediately.

As an alternative, the method of scanning may be slightly modified to avoid the need for a spur such as that from *6c* to *6d* in FIG. 6. The principle is to choose the direction of scan, either horizontal or vertical, to be the one lying closest to the normal to the line to be drawn. So horizontal scan lines are used if the line is at an angle in the range 45° to 135°, which is the case shown in FIG. 6. Then from the final position in each scan line the scanning sequence steps diagonally, moving both vertically and along in a continuation of the scanning direction of the line just concluded, that is moving directly from *6b* to *6d*. That alway takes the sample point further from the line, and the direction of the scan is then always reversed since the first element in the new line will always be of zero intensity.

Vertical scanning is used for lines at angles outside the range 45° to 136°, the step sequencer incrementing to step from element to element in the scan line. At the end of the scan line it moves to the next scan line in the manner just explained.

The method by which the vector generator 4 calculates the perpendicular distance d from the sample points to the centre line 10 will now be described.

The equation of the center line 10 is $$y=x \tan \theta+k$$

The perpendicular distance from the point (p,q) to this line is $$d=(q-k) \cos \theta-p \sin \theta$$

A step to the right in the scan increases p by 1 and therefore, as will be seen from the expression for d, changes d by $-\sin \theta$. A step to the left decreases p by 1 and changes d by $\sin \theta$. A vertical step upward increases q by 1 and changes d by $\cos \theta$.

The vector generator 4 makes use of these relationships. It is supplied by the processor 3 with the co-ordinates p and q of the starting position, its distance d from the centre line 10 and the quantities $\cos \theta$ and $\sin \theta$. Then at each step in the scan it increases or decreases d by $\cos \theta$ or $\sin \theta$ in the appropriate way for the change made in p or q. It thus keeps a running record of the perpendicular distance from the point reached by the scan to the center line 10 for use in accessing the table of sample values.

The distance calculations are carried out to a higher degree of accuracy in the fractional part of distances, than is used in the table of sample values—e.g. to six bits if the latter uses four bits.

In addition to the record of the distance to the center line 10 a record is kept of the distance from the point currently reached by the scan to the end of the line, represented (see FIG. 2) by a line 14 normal to the center line 10 and crossing it at (X,Y). The perpendicular distance L to this line is given by $$L=(Y-q) \sin \theta+(X-p) \cos \theta.$$

The changes in this distance are $-\cos \theta$ for an increase of 1 in p, $\cos \theta$ for a decrease of 1 in p and $-\sin \theta$ for an increase in q of 1. Therefore, the processor 3 supplies the vector generator 4 with the value of L for the starting position and that value is changed as required in step with the scan using the quantities $\sin \theta$ and $\cos \theta$ which are also used in changing d.

The distance to the end of the line are computed to allow images of lines of varying width to be displayed. This distance is used to access a table holding the width of the line at each length L from the end of the line. The half-width corresponding to that value of L is output and used in deriving $\Delta$ and $\phi$ to access the table of sample values.

Figure 7:
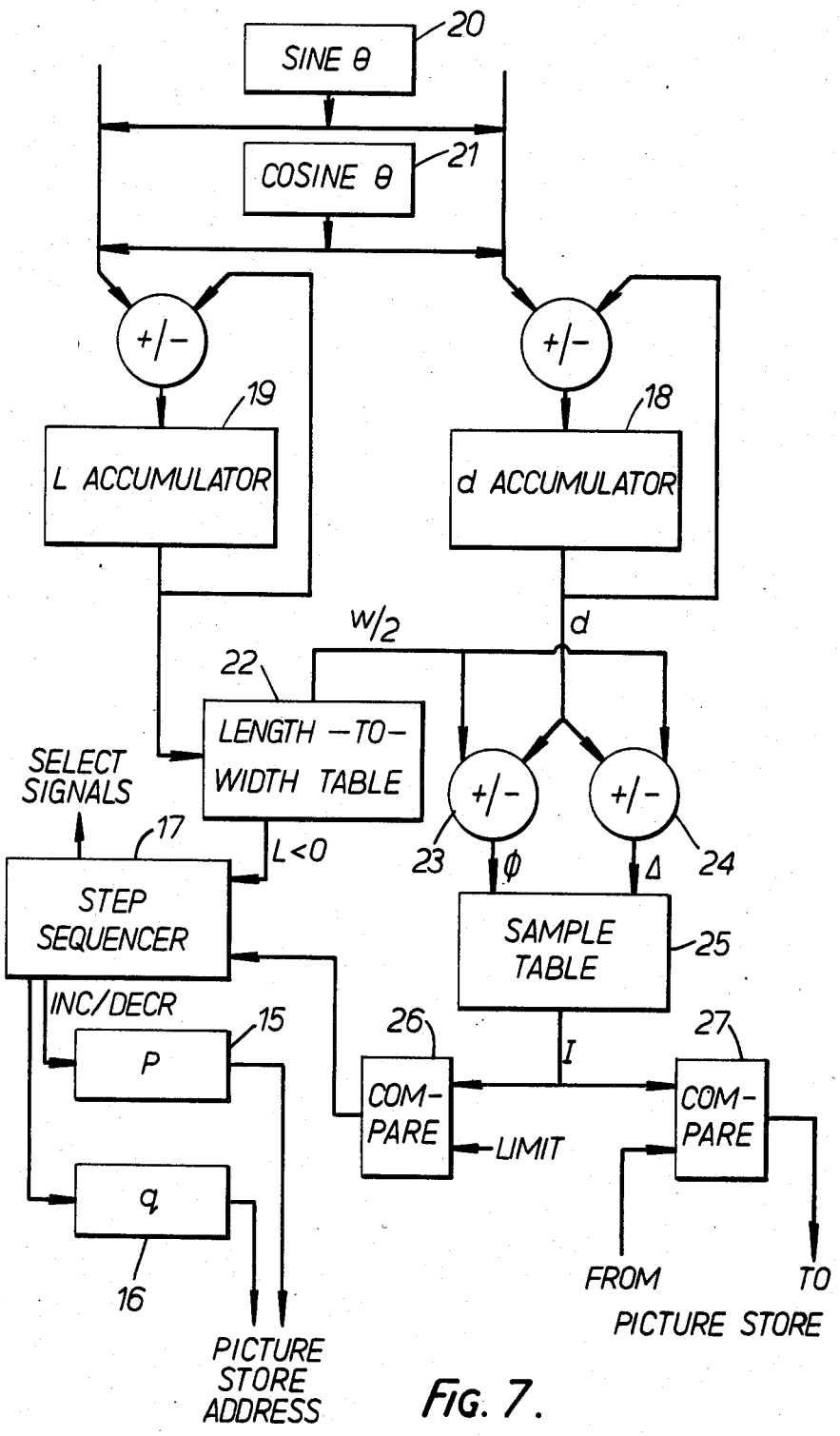
FIG. 7 is a block diagram of the vector generator.

Referring to FIG. 7, the construction of the vector generator 4 will now be described in more detail. The value of p is held in a register 15 and the value of q in a register 16. These registers can be incremented or decremented by 1 by a step sequencer 17. Their outputs are supplied as addressing signals to the picture store 2.

The values of d and L are held in accumulators 18 and 19 respectively. The values of $\sin \theta$ and $\cos \theta$ are held in registers 20 and 21 respectively. Under the control of the step sequencer 17 the value of either $\sin \theta$ or $\cos \theta$ can be applied to either the addition or subtraction input of either accumulator.

The output of the L accumulator 19 is applied to a random-access memory holding the length-to-width table 22. Its output w/2 is applied with d to adder/subtractors which calculate $\Delta$ and $\phi$ and supply them to a random-access memory holding the table of sample values 25.

The value of intensity output from the sample table 25 is compared in a comparator 26 with either the minimum or maximum possible value, as selected by the step sequencer 17. When the limit is reached a signal is passed to the step sequencer 17.

In place of a varying width the length-to-width table 22 can be set to output a constant width.

The value of the intensity output from the sample table 25 is normally written into the picture store at the address indicated by the p and q registers 15 and 16. However it is also compared in a comparator 27 with the value already stored in the picture store 2. This allows the selective overwriting of existing values in order to merge the image being generated with an existing image.

When the intensity is found to be zero for a whole scan line the step sequencer 17 terminates scanning and the image of the line is complete.

The step sequencer 17 is a microprogrammed control unit which causes the various units of the line generator 4 to operate in the manner already described, scanning by changing p and q and at the same time changing d and L as appropriate. The initial values for the desired line are loaded by the processor 3 into the registers 15,16,20 and 21 and the two accumulators 18 and 19. The half-width of the line as a function of L is loaded into the table 22. The sample table 25 is loaded with the precalculated sample values.

If all lines are of full intensity on a zero-intensity background the contents of the sample table 25 need never be changed. For this style of line the comparator 26 is set to respond to zero intensity. However, lines of different styles are catered for by calculating different sets of samples using the same sampling function 12 but a different intensity function 13. For example, the line may be of zero intensity on a full intensity background. For this case the comparator 26 is set to indicate when full intensity has been reached. An alternative is an incised line, that is, one with borders of a different intensity to the interior of the line.

One special case is the edge. For an edge the intensity function 13 is a step function and the limiting values used by the comparator 26 are a zero on one side and full intensity on the other. Lines wider than twice the unit distance may be generated as two spaced-apart edges, the region in between being filled by the processor 3 with the required intensity.

Lines may be made dotted by using a special width code for the sections of zero intensity.

Figure 8A:
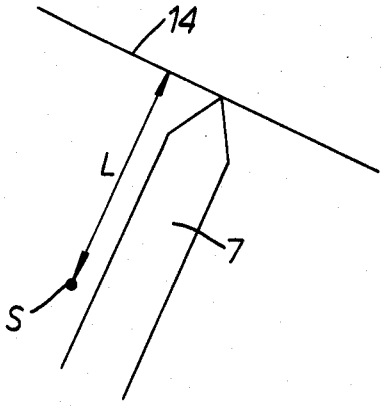
FIGS. 8*a* and 8*b* shows two methods of displaying the end of a straight line.

The end of a line is treated in one of two different ways in the vector generator shown in FIG. 7. For a precise image of the end of the line the width of the line is caused to taper, for example as shown in FIG. 8*a*. The apparent end-point will then be precisely positioned with respect to the line 14. The ability to display the end-point in this fashion is a further advantage of the way the system allows lines to be of variable width.

Figure 8B:
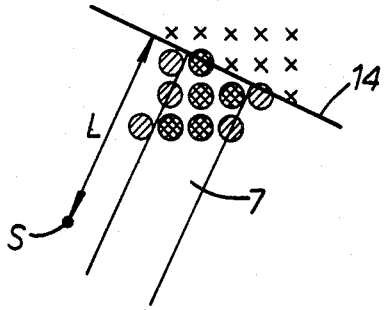

Alternatively the line may be caused to terminate with full width at the line 14, as shown in FIG. 8*b*, the image being quantised in L. Picture elements are then selected by the sequencer to have their intensities written into the picture store 2 only if L is greater than 0. Sample points shown in FIG. 8*b* by crosses are not illuminated.

The former choice is appropriate for visible ends of lines and acute junctions and the latter is appropriate for lines joined at obtuse angles.

Figure 10:
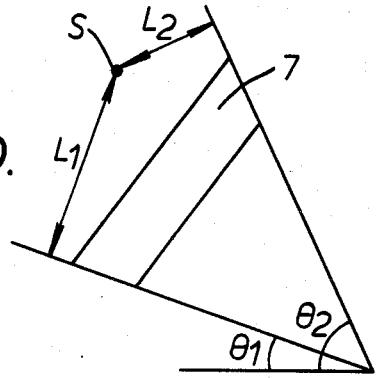
FIG. 10 is a diagram showing quantities used in the modified vector generator.
Figure 9:
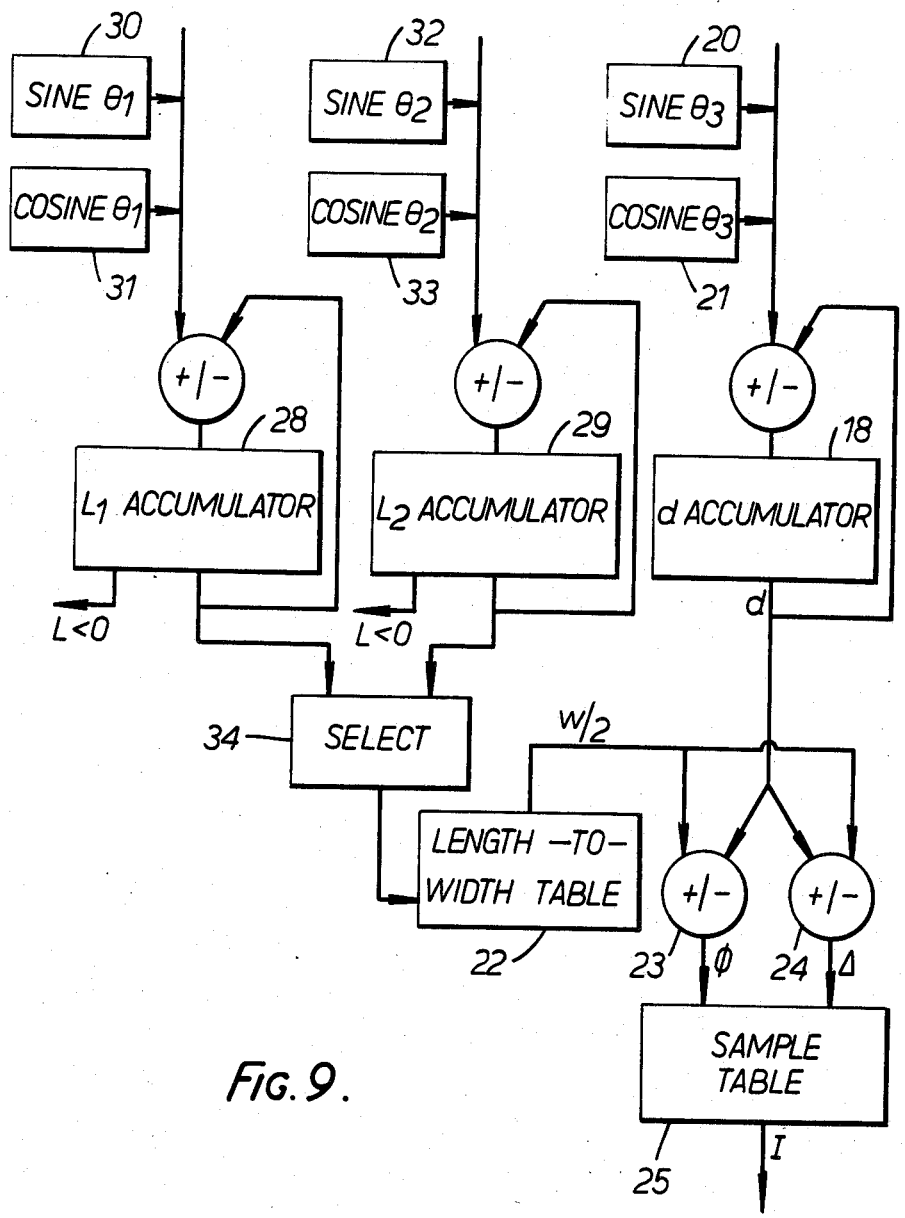
FIG. 9 is a block diagram of part of a modified vector generator.

Referring to FIG. 9, in a modification of the vector generator, the single length accumulator 19 is replaced by two length accumulators 28 and 29 holding the distances $L_1$ and $L_2$ from the sample point to the two ends of the line (see also FIG. 10). Each accumulator has its own sine and cosine registers, 30 and 31 for the accumulator 28 and 32 and 33 for the accumulator 29. This allows the terminating lines from which the distances $L_1$ and $L_2$ are measured to be other than a right angle to the centre line. Lines may then be given mitered ends by using a method like that described with reference to FIG. 8*b*. That is, an element is given zero intensity if either $L_1$ or $L_2$ is less than zero. Mitring gives a good appearance where lines join.

The outputs of the accumulators 28 and 29 are applied to a selector 34 which supplies one of them as the address to access the width table 22. The accumulator selected may be the one whose output is the lesser, in which case the distance from which the width is derived is that to the nearer end. Alternatively, the accumulator may be the same one throughout, in which case one end is chosen as the datum from which all distances are measured to define the width.

With three accumulators as shown in FIG. 9 the significance of the accumulator 18 may be modified so that the three accumulators hold the distances to the three lines forming the boundaries of a triangular area.

Figure 12:
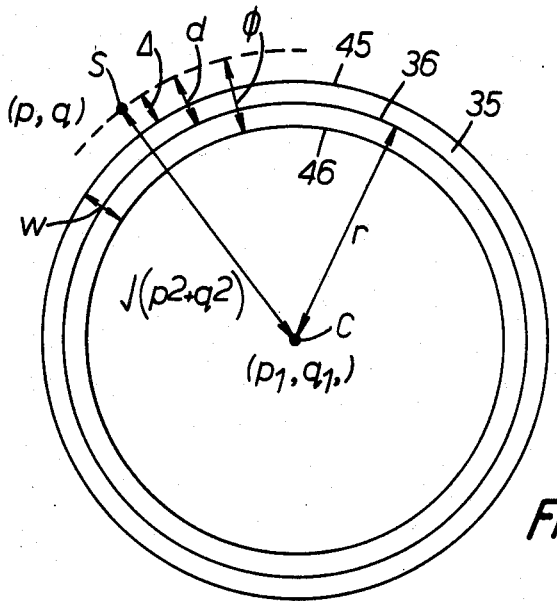
FIG. 11 is a block diagram of the circle generator and FIG. 12 is a diagram showing the quantities used in calculating intensitites for a circle.
Figure 11:
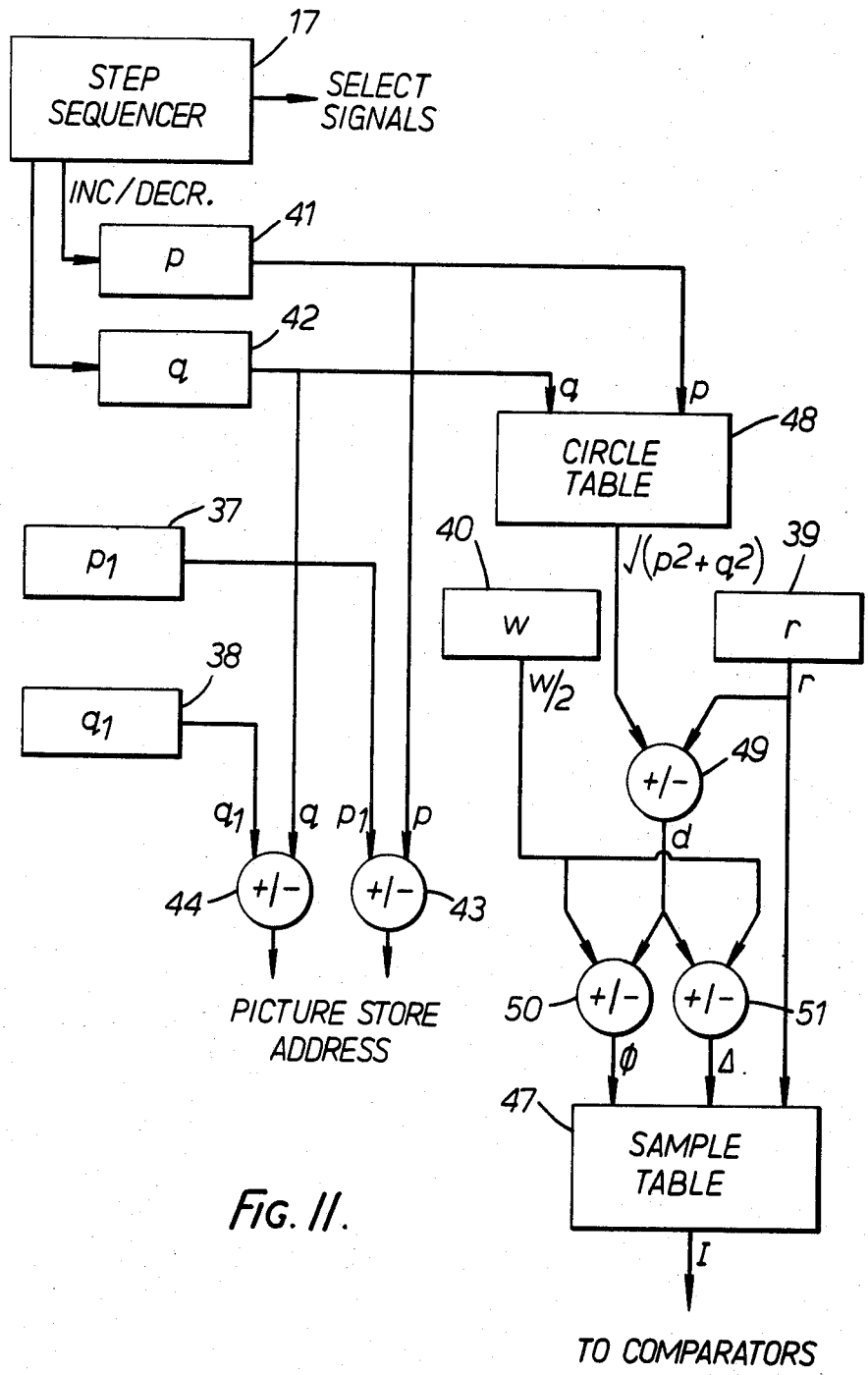

The circle generator 5 will now be described. Referring to FIGS. 11 and 12, the circle generator 5 is supplied by the processor 3 with the parameters of a circle 35 to be drawn, namely the co-ordinates ($p_1$, $q_1$) of its center C, the radius r of the circular line 36 at the center of its trace and its width w. $p_1$ and $q_1$ are loaded into registers 37 and 38, r is loaded into a register 39 and w is loaded into a register 40.

The co-ordinates (p,q,) of the sample points are defined with reference to the center C of the circle 35 and are held in registers 41 and 42 respectively. To obtain the address of the corresponding location in the picture store 2 they are added to $p_1$ and $q_2$ in adders 43 and 44.

The intensity of each sample point is derived from its closest distance d to the line 35, but in this case a two-dimensional sampling is used to take account of the curvature of the trace to be drawn. The intensity is precalculated for each possible set of values $\phi$, $\Delta$ and r, where $\Delta$ is the distance $d-w/2$ to the outer edge 45 of the circle 34 and $\phi$ is the distance $d+w/2$ to its inner edge 46. The results are loaded into a ROM to form a sample table 47 for circles.

The radial distance from the sample point S to the centre C is $\sqrt{(p^2+q^2)}$. This distance is pre-calculated for all possible values of p and q and the results are loaded into a ROM to form a circle table 48. The values of p and q for the current sample point held in the registers 41 and 42 are used to address this table, and the corresponding value of $\sqrt{(p^2+q^2)}$ is obtained. The radius r is subtracted from this value by an adder-subtractor 49 to give the quantity d for the current sample point. Half the width w/2 is substracted from r in an adder-subtractor 50 and added to it in an adder-subtractor 51 to give $\phi$ and $\Delta$ respectively. These quantities and r are applied to the sample table 47 to obtain the intensity of the current picture element. The intensity is compared, in the same way as in the vector generator, in a comparator 52 with a limiting value to control the extent of the scan and with the existing contents of the picture store for the picture element concerned to allow merging. Provided the existing intensity is not such as to over-ride it, the newly derived value will be written into the picture store.

Scanning up (or down) each side of the circle is as in the vector generator, using the spur technique since the angle of the part of the circle concerned will vary. In other words the final picture element of each scan line will be detected when its intensity matches the background.

Arcs may be drawn by including two length accumulators exactly as those for $L_1$ and $L_2$ in the modified vector generator. $L_1$ and $L_2$ are then defined to be the distances from S to the radius at the either end of the arc. A picture element having $L_1$ or $L_2$ less than zero is then given zero intensity.

In order to keep the sample table size within reasonable bounds the circle generator described is more suitable for smaller circles, say up to 16 units in radius. It has been assumed that p, q, $p_1$ and $q_1$ are integral. In that case the circle must be centered on one of the grid points represented by the center of the picture elements. A fractional position for the center of the circle may be permitted if p, q, $p_1$ and $q_1$ can take non-integral values. $p+p_1$ and $q+q_1$ must nevertheless be integral since they define a picture-element position.

General

The processor selects the initial value of (p,q) so that the scan-line starting from it includes the first picture element to differ from the background in intensity.

The direction of scanning carried out by the vector generator 4 need not be the same as the raster direction of the CRT 1, since the picture store 2 is read out independently to refresh the CRT.

The CRT may be replaced by a different display device. For a suitable device such as a plotter it may be possible to dispense with the picture store and plot the result of the scanning by the vector or circle generator directly.

Instead of using the intensity directly to control the end of the scan, the comparators 26 and 52 may respond to a value of d sufficient to give the limiting intensity.

The intensity variations may be either gray-scale variations in a monochrome display or intensity variations in a color display. In the latter case the interpolation of intensity between the inside and outside of the line is the important factor in giving a smooth appearance and any suitable interpolation of the colors may be used.

Different sampling functions may be used, and although in the case of the vector generator the use of a one-dimensional function is extremely convenient for computation, if desired a two-dimensional function may be used.

The method of generating a line of varying width by deriving a length indication for each picture element and from that deriving a width indication may be used with other scanning methods than one using the intensity to control the ends of scan lines, and in an alternative aspect the invention so provides.

I claim:

1. A method of setting intensity values for an array of picture elements to form an image of a linear feature, the method comprising scanning a plurality of paths that intersect said linear feature, each path comprising a succession of said picture elements, the scanning of each path comprising:

(a) sampling each picture element in the path in turn, (b) calculating a distance value between the sampled picture element and said linear feature, (c) utilizing the distance value calculated in step (b) above to derive an intensity value having one of several possible values for the sampled picture element, and setting the sampled picture element to that intensity value, and (d) comparing the intensity value calculated in step (c) above with a predetermined limit value and, when the predetermined limit value is reached, terminating the scanning of the path and initiating scanning of a next one of said plurality of paths.

2. A method according to claim 1 further including supplying a width value for said linear feature, wherein step (c) above utilizes said width value in addition to said distance value in order to derive said intensity value for the sampled picture element.

3. A method according to claim 2 wherein the width value is varied in accordance with a longitudinal position of the sampled picture element relative to the linear feature.

4. Apparatus for controlling a digital display device having an array of picture elements each having a controllable intensity value, to display a linear feature, the apparatus comprising:

(a) first and second address registers for containing orthogonal positional co-ordinates of a sampled picture element in the array, (b) means for stepping the first register, thereby sampling successive ones of said picture elements along a predetermined path, (c) means for calculating a distance value between each said sampled picture element and said linear feature, (d) means for utilizing said distance value to derive an intensity value having one of several possible values for the sampled picture element and for setting the sampled picture element to that intensity value, and (e) means for comparing the intensity value for the sampled picture element with a predetermined limit value and, when the predetermined limit value is reached, causing the second address register to be stepped.

* * * * *